US006126143A

United States Patent [19]

Fukunaga et al.

[11] Patent Number: 6,126,143

[45] Date of Patent: Oct. 3, 2000

[54] HOISTING WINCH FOR LIFTING AND LOWERING

[75] Inventors: Keigo Fukunaga; Yoichi Nagase; Naoya Ogawa, all of Tokyo, Japan

[73] Assignee: Mitsubishi Denki Kabushiki Kaisha, Tokyo, Japan

[21] Appl. No.: 09/245,406

[22] Filed: Feb. 5, 1999

[30] Foreign Application Priority Data

Sep. 11, 1998 [JP] Japan ..... 10-257812

[51] Int. Cl.[7] ..... B66D 1/22

[52] U.S. Cl. ..... 254/344; 254/362

[58] Field of Search ..... 254/342, 344, 254/362, 371

[56] References Cited

U.S. PATENT DOCUMENTS

| | | | |
|---|---|---|---|
| 1,585,065 | 5/1926 | Wilsing | 254/362 X |
| 2,246,923 | 6/1941 | Meunier | 254/342 X |
| 2,891,767 | 6/1959 | Armington, Jr. | 254/344 |
| 3,024,001 | 3/1962 | Worden et al. | 254/342 X |
| 3,885,656 | 5/1975 | Michling et al. | 254/344 X |
| 4,328,954 | 5/1982 | Logus | 254/344 |
| 4,430,909 | 2/1984 | Magnuson | 254/344 X |
| 5,010,981 | 4/1991 | Heikkinen | 254/342 X |
| 5,098,068 | 3/1992 | Jussila | 254/342 |

FOREIGN PATENT DOCUMENTS

| | | | |
|---|---|---|---|
| 52-121258 | 10/1977 | Japan . | |
| 4-173693 | 6/1992 | Japan . | |
| 9-506323 | 6/1997 | Japan . | |
| 6493 | 3/1908 | United Kingdom | 254/344 |

*Primary Examiner*—Donald P. Walsh
*Assistant Examiner*—Emmanuel M. Marcelo
*Attorney, Agent, or Firm*—Sughrue, Mion, Zinn, Macpeak & Seas, PLLC

[57] ABSTRACT

In a hoisting winch, a winding drum is arranged in an outer peripheral portion of a motor portion, a braking unit and an encoder are arranged on one end side of a rotor axis of the motor portion, an internal gear is fitted to an inner diameter area of the winding drum, a reduction mechanism in which planet gears are arranged between a sun gear and the internal gear is provided, the reduction mechanism, the braking unit, and the encoder are arranged in a coaxial fashion, and a wire rope fitting groove is provided on the winding drum on the braking unit side.

6 Claims, 5 Drawing Sheets

HOISTING WINCH FOR LIFTING AND LOWERING

BACKGROUND OF THE INVENTION

1. Field of the Invention

The present invention relates to a hoisting winch for lifting up and lowering, for example, a cage of a "home elevator", etc.

2. Description of the Related Art

By way of example, a configuration of a conventional hoisting winch employed in the home elevator, etc. is shown in FIG. 8. In FIG. 8, a reference 1 denotes a motor portion; 2, a braking means; 2*a,* a brake axle for connecting the motor portion 1 and the braking means 2; 3, an encoder for counting the number of revolution of the motor portion 1; 3*a,* a rotation axle for connecting the braking means 2 and the encoder 3; 4, reduction mechanism; 4*a,* an input axle of the reduction mechanism 4 connected to an output axle of the motor portion 1; and 4*b,* an output axle of the reduction mechanism 4. A reference 5 denotes a winding drum which is coupled to the output axle of the reduction mechanism 4 and on which a wire rope 6 being connected to the cage of the home elevator is wound.

According to this configuration, in its stop state, the braking means 2 is brought into its locking state not to rotate the brake axle 2*a* which is connected to the motor portion 1. When a voltage is supplied and an ascending or descending command signal is supplied, the braking means 2 is released and at the same time a rotor axle of the motor portion 1 begins to turn. Then, the input axle 4*a* of the reduction mechanism 4 also begins to turn, then the number of revolution is reduced in the reduction mechanism 4, then the winding drum 5 is turned at a certain revolution speed, which is reduced lower than the output axle 4*b,* to wind or rewind the wire rope 6. When a stop command is supplied, the revolution of the rotor axle of the motor portion 1 stops, and thus a rotation of a rotor stops at a predetermined position by the braking means 2. At the same time, the rotor axle of the motor portion 1 is locked by the braking means 2 to thus stop the reduction mechanism 4 and the winding drum 5. The encoder 3 counts the number of revolution of the motor portion 1 to detect a position of the cage of the home elevator. The cage of the home elevator can be controlled such that, when a stop floor is instructed by a set signal to set the count number of the position where the cage must be stopped, such cage can stop at a predetermined position at a predetermined floor.

As described above, there has been some problems that, since the conventional hoisting winch for lifting up and lowering the cage of the home elevator, etc. has the configuration in which the motor portion 1, the reduction mechanism 4, and the winding drum 5 are arranged in parallel, a weight of the hoisting winch becomes heavy. In addition, there has been another problem that, when the wire rope 6 is wound on the winding drum 5 or rewound from the winding drum 5, the vibration and the noise are generated and then propagated to the cage of the home elevator because of a clearance of the motor portion 1 or a bearing portion of the winding drum 5, so that the home elevator becomes uncomfortable to ride.

SUMMARY OF THE INVENTION

The present invention has been made to overcome the above problems and it is an object of the present invention to provide a hoisting winch which can have small dimensions, a small installation area, and a light weight, and can suppress vibrations and noises generated by a clearance formed in a motor portion or a bearing portion of a winding drum.

A hoisting winch according to a first aspect of the present invention comprises: a first supporting member and a second supporting member placed to oppose to each other; a motor portion including: a motor portion whose one end is supported by the first supporting member; and a rotor which is installed into an inner diameter area of the motor portion and supposed rotatably by both ends of the motor portion; one end side of a rotor axle protruded from the first supporting member, and the other end side of the rotor axle being provided with a sun gear at a top thereof; a cylindrical winding drum arranged on an outer periphery of the motor portion and on which a wire rope for lifting up and lowering a hoist load is wound, both ends of the winding drum being supported rotatably against the first supporting member and the second supporting member, and the winding drum including a fitting groove for fitting the wire rope fixed the one end of the wire rope on the winding drum; a reduction mechanism having an internal gear fitted onto an other end inner peripheral area of the winding drum, and planet gears arranged between the internal gear and the sun gear; a braking means inserted into the rotor axle projected from the first supporting member such that the braking means is supported by the first supporting member, a center portion of the braking means being coupled to the rotor axle; and an encoder attached to a top of the one end of the rotor axle to count a number of revolution of the rotor axle of the motor portion.

In the hoisting winch according to a second aspect of the present invention, the reduction mechanism of the first aspect is constructed as a two-stage reduction mechanism which comprises: a first stage internal gear and a second stage internal gear which are fitted in parallel to an other end side inner periphery of the winding drum; first planet gears which are arranged between the first stage internal gear and the sun gear provided to the top of the other end side of the rotor axle; a first gear platform supporting rotation axes of the first planet gears; a second sun gear placed at a center position of the second stage internal gear and provided to the first gear platform; second planet gears arranged between the second sun gear and the second stage internal gear; and a second gear platform to which rotation axle of the second planet gears are attached and which is supported by the second supporting member.

In the hoisting winch according to a third aspect of the present invention, in the reduction mechanism of the first aspect, the sun gear provided to the top of the other end side of the rotor axle, the first stage planet gears which engage with the sun gear, and the first stage internal gear fitted on an other end side inner peripheral area of the winding drum are formed of a helical gear respectively, and a helix angle of the helical gear is set such that a thrust force for thrusting the winding drum is caused when a tension of the wire rope wound on the winding drum is applied.

In the hoisting winch according to a fourth aspect of the present invention, in the reduction mechanism of the second aspect, the sun gear provided to the top of the other end side of the rotor axle, the first stage planet gears which engage with the sun gear, and the first stage internal gear fitted on an other end side inner peripheral area of the winding drum are formed of a helical gear respectively.

In the hoisting winch according to a fifth aspect of the present invention, in the reduction mechanism of the first aspect, the planet gears which engage with the sun gear provided to the top of the other end side of the rotor axle are composed of at least three gears, and an angular interval between neighboring planet gears along a circumference direction is set not to exceed 180 degree.

In the hoisting winch according to a sixth aspect of the present invention, in the reduction mechanism of the first aspect, internal gears of the reduction mechanism are formed integrally with the winding drum.

BRIEF DESCRIPTION OF THE DRAWINGS

Similar reference characters denote corresponding features consistently throughout the attached figures. The preferred embodiments of this invention will be described in detail, with reference to the following figures, wherein.

DESCRIPTION OF THE PREFERRED EMBODIMENTS

Embodiments of the present invention will be explained in detail with reference to the accompanying drawings hereinafter.

Embodiment 1

Figure 1:
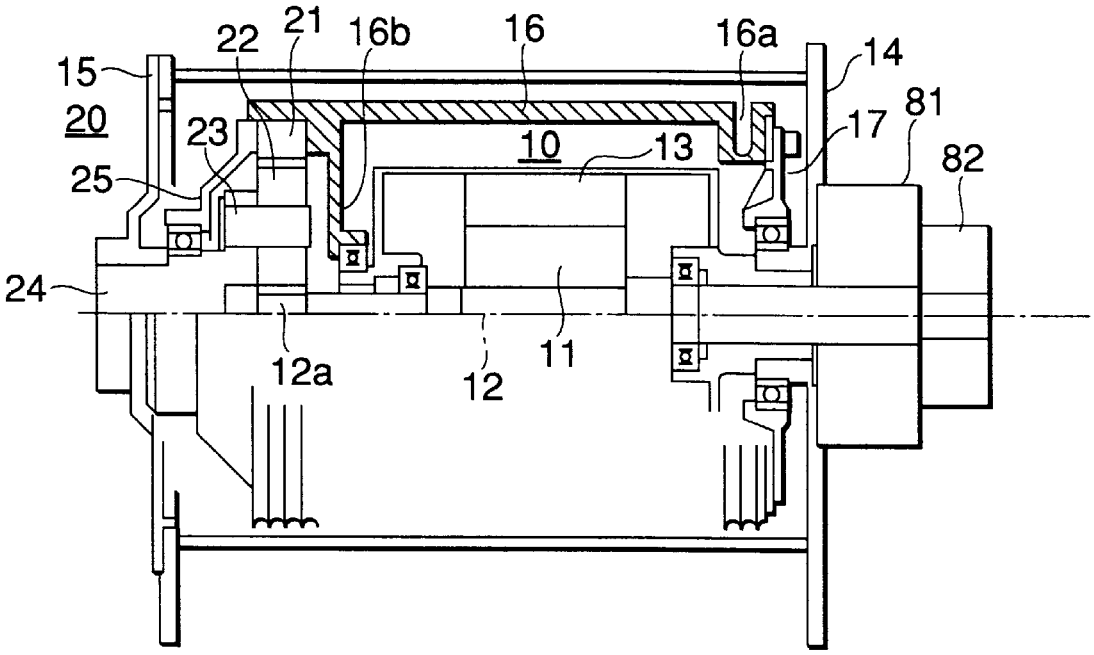
FIG. 1 is a view showing a configuration of a hoisting winch according to a first embodiment of the present invention.

A configuration of a hoisting winch according to a first embodiment of the present invention is shown in FIG. 1. This first embodiment shows a configuration in which a single stage type reduction mechanism is employed. In FIG. 1, a reference 10 denotes a motor portion which is composed of a rotor 11 whose rotor member is fitted to a rotor axle 12 located in a center portion, and a motor portion 13. One end of the rotor axle 12 is projected from a first supporting member described later to penetrate therethrough, and a sun gear 12*a* for rotating a reduction gear portion is provided to the other end of the rotor axle 12. A reference 14 denotes the first supporting member; 15, a second supporting member; and 16, a winding drum on which a wire rope for lifting up and lowering the hoist load is wound. Guide grooves for the wire rope are formed on an outer periphery of the winding drum 16. A wire rope fitting groove 16*a*, on which the wire rope for lifting up and lowering the hoist load is wound, is provided on the outer periphery on one end side of the winding drum 16. A motor supporting portion 16*b* for supporting the other end side of the motor member 10 is formed on an inner diameter portion on the other end side of the winding drum 16. A reference 17 denotes a winding drum supporting member for supporting rotatably one end side of the winding drum 16 onto the first supporting member 14.

A reference 20 is a reduction mechanism. This reduction mechanism 20 has an internal gear 21 fitted on an inner periphery on the other end side of the winding drum 16, planet gears 22 placed between a sun gear 12*a* provided on the other end side of the rotor axle 12 and the internal gear 21, a gear axle 23 for supporting rotatably the planet gears 22, a gear platform 24 for supporting the gear axle 23 onto the second supporting member 15, and a reduction gear cover 25 for covering the internal gear 21 and the planet gears 22. A reference 81 is a braking means. This braking means 81 is fitted onto a projected portion of the rotor axle 12 and then fixed to the first supporting member 14. A central portion of the braking means 81 is coupled to the rotor axle 12. The braking means 81 is brought into a state to lock the rotor axle 12 when the motor member 10 is stopped, and then its locking state of the braking means 81 is released when the motor member 10 is started to turn. A reference 82 is an encoder which counts the number of revolution of the motor member 10.

When the voltage is supplied to the motor member 10 of the hoisting winch according to an ascending or descending command signal, a locking state of the rotation axle of the braking means 81 is released and then the rotor axle 12 is turned. Then, the number of rotation is reduced by the reduction mechanism 20 and then the winding drum 16 is turned to wind or rewind the wire rope.

A configuration in which the winding drum 16 of the hoisting is arranged on an outer periphery of the motor member 10, and also respective portions such as the reduction mechanism 20, the braking means 81, the encoder 82, etc. are arranged in a coaxial fashion is employed. Therefore, the hoisting winch which has reduced outer dimensions and a reduced installation area can be constructed.

In this manner, the wire rope fitting groove 16*a* of the winding drum 16 can be positioned on the first supporting member 14 side. Hence, fitting/winding operations of an end portion of the wire rope onto the winding drum 16 can be effected from one side of the hoisting winch in installation. In addition, in the periodic inspection which is carried out to ensure the safety of the hoisting winch, items such as confirmation/adjustment of a braking torque of the braking means 81, confirmation of the fitting state of the wire rope on the winding drum 16, and others are checked. In such periodic inspection, the hoisting winch can be checked from one side, so that a working time on the other side of the hoisting winch can be reduced. As a result, an installation space necessary for the hoisting winch can be made small.

Embodiment 2

Figure 2:
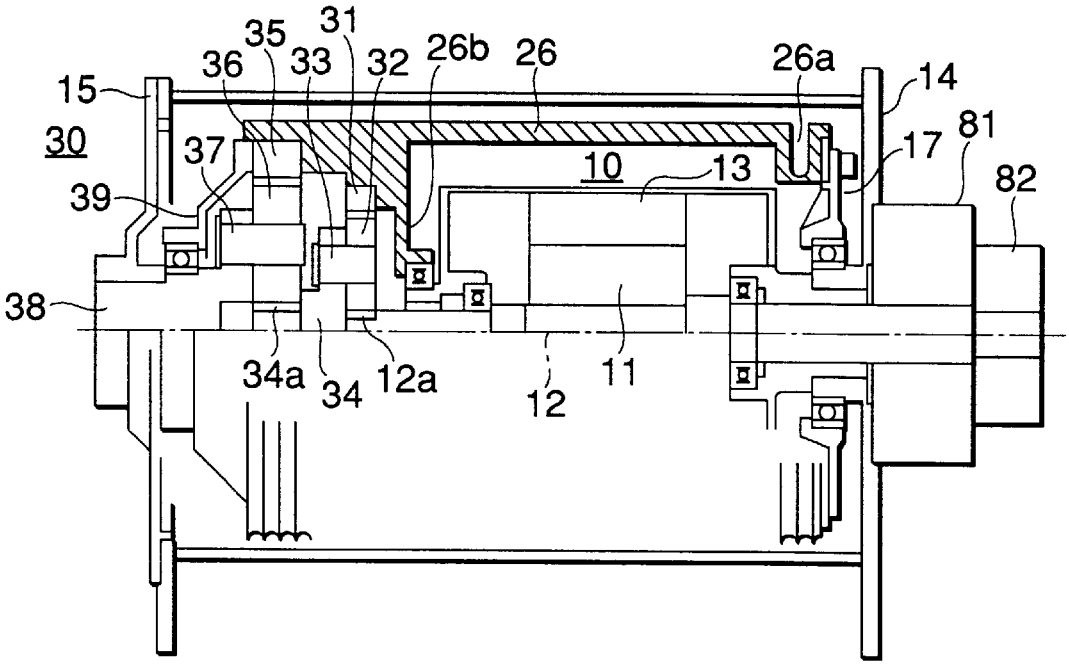
FIG. 2 is a view showing a configuration of a hoisting winch, in which a two-stage type reduction mechanism is provided, according to a second embodiment of the present invention.

A configuration of a hoisting winch according to a second embodiment of the present invention is shown in FIG. 2. In this second embodiment, the motor portion and the winding drum have the same configurations as those in the first embodiment, but a two-stage type reduction mechanism is provided to increase the reduction gear ratio. In FIG. 2, references 10 to 15, 17, 81, 82 denote the identical parts to those shown in FIG. 1 in the first embodiment. A reference 26 denotes a winding drum on which the wire rope is wound. One end and the other end of the winding drum 26 are supported rotatably to the first supporting member 14 and the second supporting member 15 respectively. A wire rope fitting groove 26*a* is provided on an outer peripheral surface near the one end side of the first supporting mechanism 14. The wire rope for lifting up and lowering the hoist load is wound on the winding drum 26. A motor supporting portion 26*b* for supporting the other end side of the motor is provided on an inner diameter area of the winding drum 16. A reference 30 denotes a reduction mechanism. This reduction mechanism 30 has a sun gear 12*a* provided on an end portion of the rotor axle 12, a first stage internal gear 31 fitted on an inner peripheral surface of the winding drum 26 on the motor member 10 side, first stage planet gears 32 arranged between the sun gear 12*a* and the first stage internal gear 31, a gear axle 33 for supporting rotatably the first stage planet gears 32, a first gear platform 34 for supporting the gear axle 33 and having a second sun gear 34*a* on its other end side, a second stage internal gear 35 fitted on an inner peripheral surface of the winding drum 26 on the other side, second stage planet gears 36 arranged between the second sun gear 34*a* and the second stage internal gear 35, a second gear axle 37 for supporting rotatably the second stage planet gears 36, a second gear platform 38 for supporting the second gear axle 37 onto the second supporting member 15, and a reduction gear cover 39 for covering engage portions of respective gears.

Figure 3:
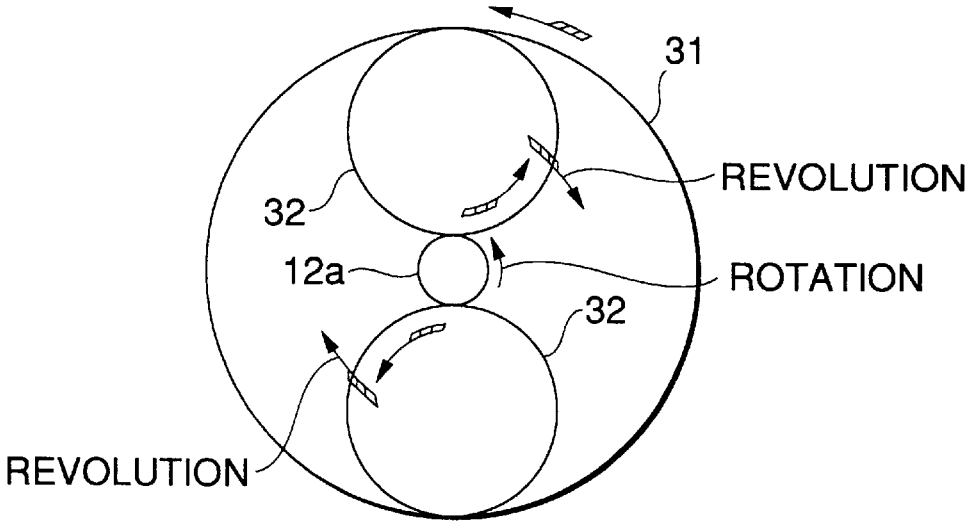
FIG. 3 is a view showing a turning operation of the reduction mechanism shown in FIG. 2.

A turning operation of the winding drum 26 by using the reduction mechanism 30 in this configuration will be explained hereinbelow. A front view illustrative of a rotation state of the first stage planet gear portion is shown in FIG. 3. In FIG. 3, when the sun gear 12*a* provided on the end portion of the rotor axle 12 of the motor member 10 is turned clockwise, a plurality of planet gears 32 are turned counterclockwise and also the winding drum 26 on which the first stage internal gear 31 is fitted is turned counterclockwise. When the winding drum 26 is turned counterclockwise, the second stage planet gears 36 are turned counterclockwise and also the second sun gear 34*a* provided on the other end portion of the first gear platform 34 is turned clockwise. The first stage planet gears 32 are supported to the first gear platform 34, and therefore the first stage planet gears 32 are revolved counterclockwise while rotating around the rotor axle 12 of the motor member 10 when the first gear platform 34 is turned. Therefore, a reduction gear ratio becomes large rather than the first embodiment. This configuration is suitable for the case where the enlarged reduction gear ratio is requested. The dimension of the reduction mechanism 30 is not so increased no matter how the reduction gear ratio is set large, and thus the hoisting winch can be constructed small in size and light in weight.

In this configuration, like the first embodiment, when the voltage is supplied to the motor member 10 of the hoisting winch in answer to the ascending or descending signal, a locked state of the rotor axle 12 by the braking means 81 can be released. Then, the rotor axle 12 is turned, then the number of revolution is reduced by the reduction mechanism 30, and then the winding drum 26 is turned to wind or rewind the wire rope.

As described above, in case the enlarged reduction gear ratio is requested, the two-stage type reduction mechanism in which the winding drum 26 is arranged on the outer periphery of the motor member 10 to be placed in the concentric fashion is employed, so that its outer dimension can be reduced.

Like the first embodiment, because the wire rope fitting groove 26*a* of the winding drum 26 is provided on the first supporting member 14 side, the fitting/winding operations of the end of the wire rope onto the winding drum 26 can be conducted on one side in installation. In addition, the periodic inspection which is carried out to ensure the safety of the hoisting winch can be checked from one side, so that the working space and time on the other side of the hoisting winch can be reduced. As a result, the installation space necessary for the hoisting winch can be reduced small.

Embodiment 3

Figure 4:
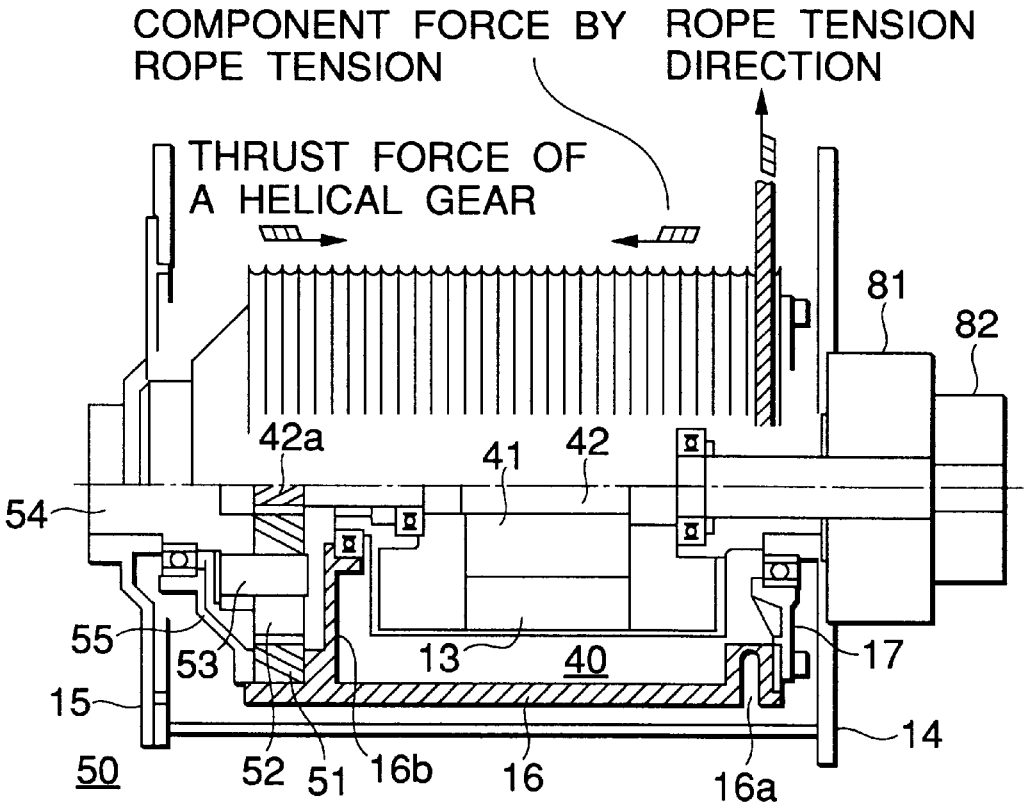
FIG. 4 is a view showing a configuration of a hoisting winch, in which helical gears are employed as gears of the reduction mechanism, according to a third embodiment of the present invention.

A configuration of a hoisting winch according to a third embodiment of the present invention is shown in FIG. 4. In this third embodiment, vibrations and noises caused because of minute clearances in supporting portions which are supported rotatably on the motor portion, the winding drum, etc. can be suppressed. In FIG. 4, references 13 to 17, 81, 82 denote the identical members to those shown in FIG. 1 in the first embodiment. A reference 40 denotes a motor portion which is composed of a rotor 41 whose rotor member is fitted to a rotor axle 42 located in a center portion, and the motor portion 13. One end of the rotor axle 42 is projected from the first supporting member 14 to penetrate therethrough, and a sun gear 42*a* of the reduction mechanism is provided to the other end of the rotor axle 42 as helical gears.

A reference 50 is a reduction mechanism. This reduction mechanism 50 has an internal gear 51 fitted on an inner periphery on the other end side of the winding drum 16, planet gears 52 placed between a sun gear 42*a* provided on the other end side of the rotor axle 42 and the internal gear 51, a gear axle 53 for supporting rotatably the planet gears 52, a gear platform 54 for supporting the gear axle 53 onto the second supporting member 15, and a reduction gear cover 55 for covering the internal gear 51 and the planet gears 52. The sun gear 42*a,* the internal gear 51, and the planet gears 52 are formed as the helical gears. A helix angle of the helical gear relative to rotation of the rotor axle 42 of the motor portion 40 is set to apply a thrust force to the winding drum 16 when a rewinding force of the wire rope wounded on the winding drum 16 acts on the winding drum 16. According to this configuration, the hoisting winch can be constructed by fitting the one end of the wire rope onto the wire rope fitting groove 16*a* provided on the first supporting member 14 side of the winding drum 16, and then winding the wire rope of a predetermined length on the winding drum 16.

In the hoisting winch constructed as above, a rotating force for rewinding the wire rope from the winding drum 16 is generated when the hoist load acts on the wire rope being wound on the winding drum 16. When this rotating force is applied to the helical gears, the winding drum 16 is pushed against the first supporting member 14 side and thus the rotation supporting portion of the rotor axle 42 of the motor portion 40 and the rotation supporting portion of the winding drum 16 are pushed toward one side. The wire rope generates thrust force because the winding drum groove is also helical. As a result, the rotor of the motor and the winding drum 16 can be prevented being swung in the axial direction during lifting up or lowering the hoist load to suppress the vibrations. When they are employed to the elevator, the vibration being propagated to the cage of the elevator can be reduced to provide the elevator with a comfortable riding feeling.

In the third embodiment, the case where the single stage reduction mechanism is constructed by the helical gears has been explained hereinbefore. However, in order to achieve the same advantages as the case where the two-stage reduction mechanism is employed in the second embodiment, if the sun gear 42*a,* the internal gear 51, and the first stage planet gears 52 in the configuration shown in FIG. 2 are implemented by the helical gears, the rotatable supporting portions are thrust toward one side. As a result, the vibrations caused by the ascent or descent of the elevator can be suppressed.

Embodiment 4

Figure 5:
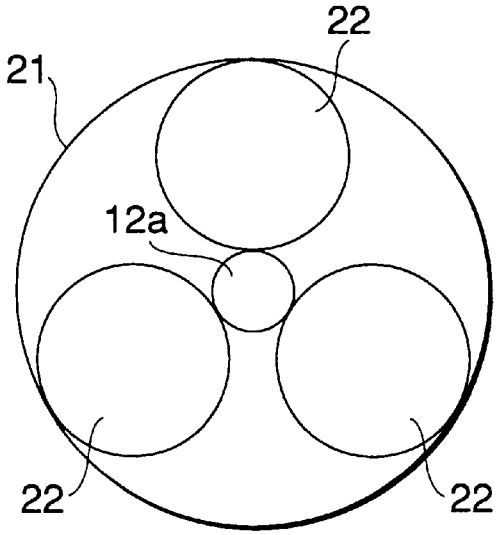
FIG. 5 is a view showing an arrangement of planet gears in case three planet gears are employed in the reduction mechanism, according to a fourth embodiment of the present invention.
Figure 6:
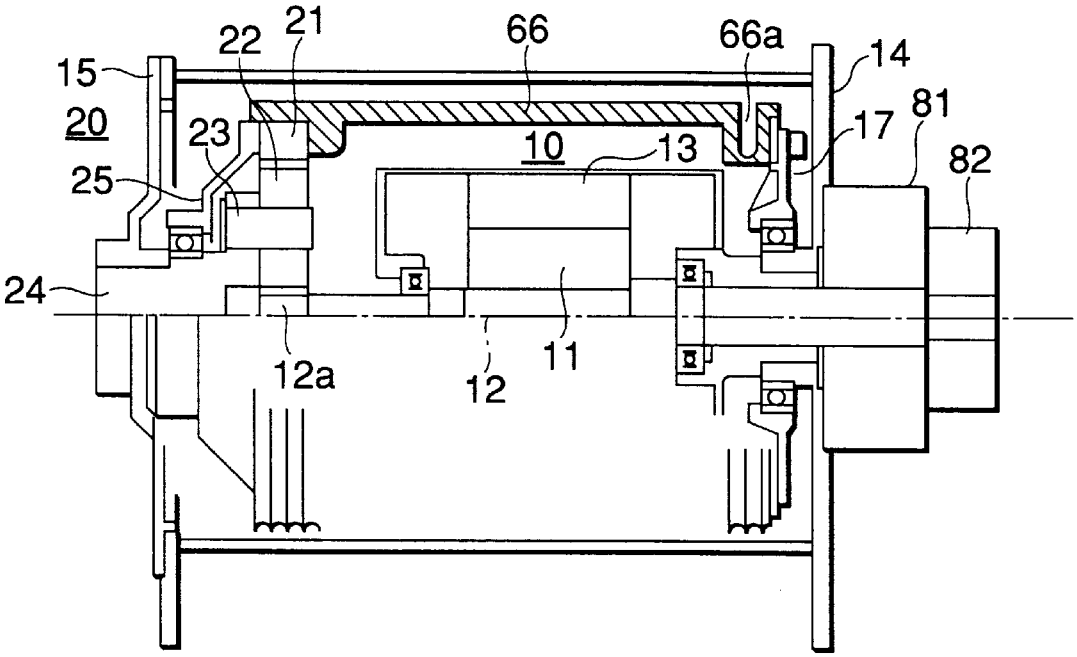
FIG. 6 is a view showing a configuration of a hoisting winch, in which three planet gears are employed, according to the fourth embodiment of the present invention.

A fourth embodiment of the present invention has a configuration that the planet gears 22 in the reduction mechanism 20 shown in FIG. 1 in the first embodiment are formed by at least three gears, to thus eliminate the support of the rotor axle 12 of the motor member 10 on the other end side. There is shown in FIG. 5 a relationship between the sun gear 12*a* provided onto the other end portion of the rotor axle 12 and the planet gears 22 when three planet gears are employed in the reduction mechanism. A configuration is shown in FIG. 6 in which the support of the rotor axle 12 of the motor portion 10 on the other end side can be eliminated by forming the planet gears 22 of the reduction mechanism by three gears. In FIG. 6, references 10 to 15, 17, 20 to 25 denote the identical parts to those shown in FIG. 1 in the first embodiment. A reference 66 denotes a winding drum. A motor supporting portion for supporting the other end side of the motor member 10 provided on an inner diameter portion on the other end side can be eliminated. Like the first embodiment, a wire rope fitting groove 66*a* is provided on the first supporting portion side. The wire rope for lifting up and lowering the hoist load is wound on the winding drum 66.

In case three or more planet gears 22 are employed, a 360 degree/number is ideal for an angular interval between respective gears. However, a center of the sun gear 12*a* being provided at the top end of the rotor axle 12 can be still maintained by setting an angular interval between the adjacent planet gears 22 to 180 degree or less. Since three gears are provided as the planet gears 22 in this manner, there is no necessity of supporting the sun gear 12*a* being provided onto the rotor axle 12. As a result, as shown in FIG. 6, the hoisting winch can be constructed not to support the other end side of the motor member 10, so that such an advantage can be achieved that the lateral length of the hoisting winch can be reduced.

In this way, when to construct the planet gears by at least three gears is applied to the case where two-stage reduction mechanism is employed in the second embodiment, similar advantages can be obtained by constructing the first stage planet gears 32 by three gears.

Embodiment 5

Figure 7:
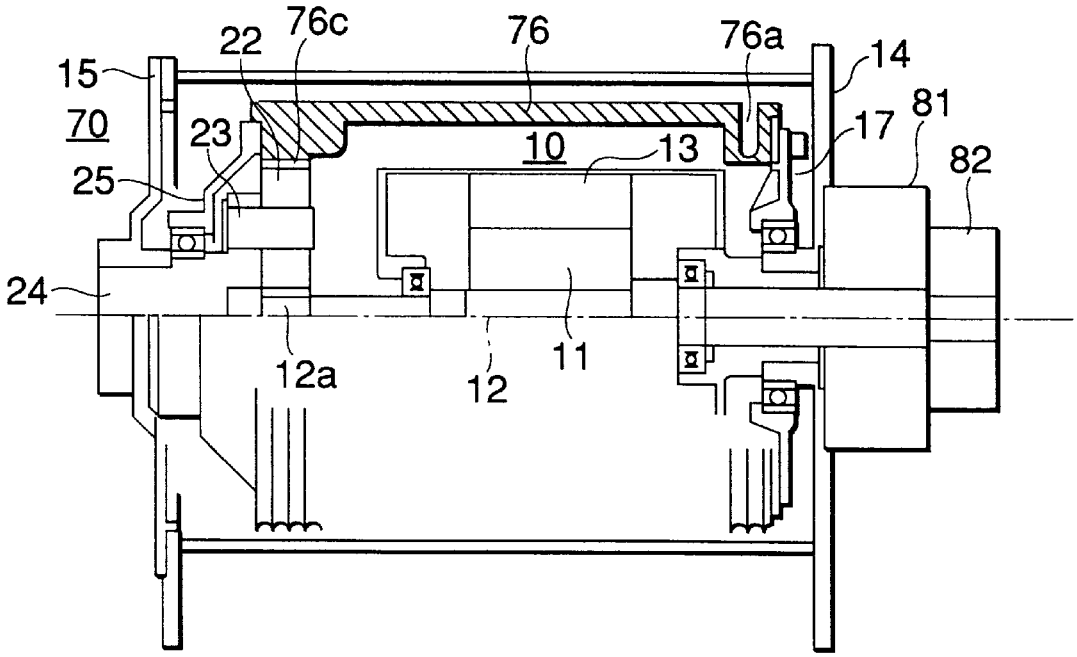
FIG. 7 is a view showing a configuration of a hoisting winch, in which an internal gear is formed integrally with a winding drum, according to a fifth embodiment of the present invention.
Figure 8:
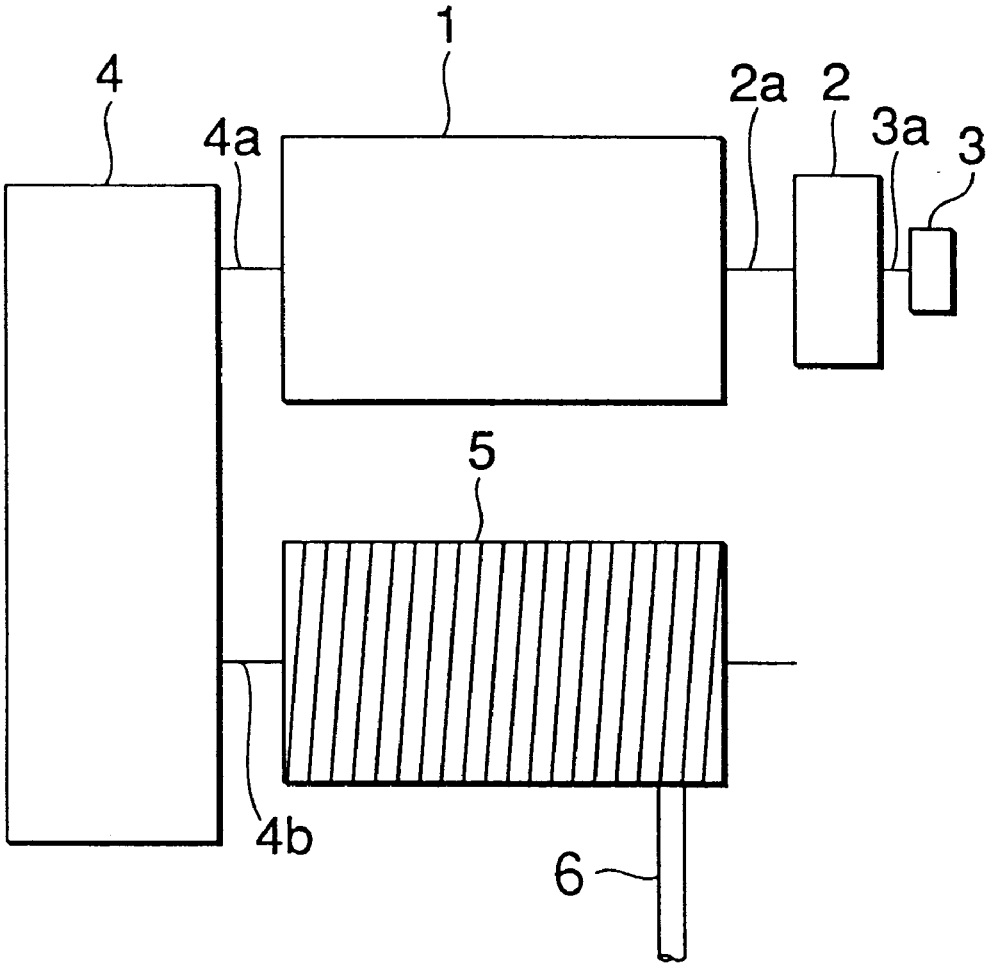
FIG.8 PRIOR ART
FIG. 8 is a view showing a configuration of a hoisting winch in the related art.

In a hoisting winch according to a fifth embodiment of the present invention, an internal gear of a reduction mechanism is formed integrally with a winding drum at a predetermined position. A configuration of the hoisting winch is shown in FIG. 7. In FIG. 7, references 10 to 15, 17, 22 to 25 denote the identical parts to those shown in FIG. 1 in the first embodiment. A reference 76 denotes a winding drum. A wire rope fitting groove 76*a* is provided on the first supporting member 14 side, and the wire rope for lifting up and lowering the hoist load is wound on the winding drum 76. An internal gear 76*c* of the reduction mechanism is formed integrally with the winding drum at the inner periphery portion on the other end side. A reference 70 denotes a reduction mechanism. In this reduction mechanism, the internal gear 76*c* is formed integrally with the winding drum 76, but remaining parts are the same as those in the first embodiment.

In this manner, if the internal gear 76*c* of the reduction mechanism 70 is formed integrally with the winding drum 76 in this way, the number of parts can be reduced, then an assembling operation can be made simply, and then reduction in cost can be achieved. This configuration in which the internal gear can be formed integrally with the winding drum may be applied to the above first to fourth embodiments.

According to the hoisting winch according to a first aspect of the present invention, the winding drum is arranged in an outer peripheral portion of the motor portion, the braking means and the encoder are arranged on one end side of the rotor axle of the motor portion, the internal gear is fitted to the inner diameter area of the winding drum, the reduction mechanism in which planet gears are arranged between the sun gear and the internal gear is provided, the reduction mechanism, the braking means, and the encoder are arranged in a coaxial fashion, and the wire rope fitting groove is provided on the winding drum on the braking means side. Therefore, fitting/winding operations of an end portion of the wire rope onto the winding drum 16 can be effected from one side of the hoisting winch in installation. In addition, the periodic inspection which is carried out to ensure the safety of the hoisting winch can be checked from one side. As a result, the working time and space on the other side of the hoisting winch can be reduced and the installation space necessary for the hoisting winch can be made small.

According to the hoisting winch according to a second aspect of the present invention, the reduction mechanism of the first aspect is constructed to have a two-stage planet gears. Therefore, the hoisting winch applicable for the case where the large reduction gear ratio is requested not to so increase the dimension of the reduction mechanism can be constructed small in size and light in weight.

According to the hoisting winch according to a third aspect of the present invention, in the reduction mechanism of the first aspect, the sun gear provided to the other end side top end of the rotor axle of the motor portion in the reduction mechanism, the first stage planet gears which engage with the sun gear, and the first stage internal gear fitted on an other end side inner peripheral area of the winding drum are formed of a helical gear respectively, and the helix angle of the helical gear is set such that a thrust force for thrusting the winding drum is caused when a tension of the wire rope wound on the winding drum is applied to the helical gear. Therefore, the rotation supporting portion of the rotor axle of the motor portion and the rotation supporting portion of the winding drum are pushed toward one side. As a result, the rotor of the motor and the winding drum can be prevented being swung in the axial direction during lifting up or lowering the hoist load to thus suppress the vibrations.

According to the hoisting winch according to a fourth aspect of the present invention, in the reduction mechanism of the second aspect, the sun gear provided to the other end side top end of the rotor axle of the motor portion in the reduction mechanism, the first stage planet gears which engage with the sun gear, and the first stage internal gear fitted on an other end side inner peripheral area of the winding drum are formed of a helical gear respectively. Therefore, like the third aspect, the rotation supporting portion of the rotor axle of the motor portion and the rotation supporting portion of the winding drum are pushed toward one side. As a result, the rotor of the motor and the winding drum can be prevented being swung in the axial direction during lifting up or lowering the hoist load to thus suppress the vibrations.

According to the hoisting winch according to a fifth aspect of the present invention, in the reduction mechanism of the first aspect, the planet gears are composed of at least three gears, and the angular interval between neighboring planet gears along a circumference direction is set not to exceed 180 degree. Therefore, the dimension of the hoisting winch along the longitudinal direction can be reduced, and thus a size of the hoisting winch can be reduced much more.

According to the hoisting winch according to a sixth aspect of the present invention, in the reduction mechanism of the first aspect, the internal gear of the reduction mechanism is formed integrally with the winding drum. Therefore, the number of parts can be reduced, and an assembling operation can be carried out easily.

The entire disclosure of each and every foreign patent application from which the benefit of foreign priority had been claimed in the present application is incorporated herein by reference, as if fully set forth.

While only certain embodiments of the invention have been specifically described herein, it will apparent that numerous modifications may be made thereto without departing from the spirit and scope of the invention.

What is claimed is:

1. A hoisting winch comprising:

a first supporting member and a second supporting member positioned to oppose each other;

a motor member including:

a motor portion whose one end is supported by said first supporting member; and a rotor which is installed into an inner diameter area of said motor portion and supported rotatably by both ends of said motor portion, one end side of a rotor axle of said rotor being protruded from said first supporting member, and the other end side of said rotor axle being provided with a sun gear;

a cylindrical winding drum arranged on an outer periphery of said motor portion and on which a wire rope for lifting and lowering a hoist load is wound, both ends of said winding drum being supported rotatably against said first supporting member and said second supporting member, and said winding drum includes a fitting groove for fitting one end of said wire rope on said winding drum;

a reduction mechanism having an internal gear fitted onto an inner peripheral area of said winding drum, and planet gears arranged between said internal gear and said sun gear;

a braking means inserted onto said rotor axle projected from said first supporting member, wherein said braking means is supported by said first supporting member, and a center portion of said braking means being coupled to said rotor axle; and an encoder attached to said one end of the protruding rotor axle to count a number of revolutions of said rotor axle of said motor portion.

2. A hoisting winch according to claim 1, wherein said reduction mechanism is constructed as a two-stage reduction mechanism which comprises:

a first stage internal gear and a second stage internal gear which are fitted in parallel to said inner peripheral area of said winding drum;

first stage planet gears which are arranged between said first stage internal gear and said sun gear provided to said other end side of said rotor axle;

a first gear platform supporting rotation axles of said first stage planet gears;

a second sun gear placed at a center position of said second stage internal gear and provided at said first gear platform;

second stage planet gears arranged between said second sun gear and said second stage internal gear; and a second gear platform to which rotation axles of said second stage planet gears are attached and which is supported by said second supporting member.

3. A hoisting winch according to claim 2, wherein said sun gear provided to said other end side of said rotor axle, said first stage planet gears which engage with said sun gear, and said first stage internal gear fitted on said other end side inner peripheral area of said winding drum are formed of a helical gear respectively, and a helix angle of said helical gear is set to cause a thrust force for thrusting said winding drum when a tension of said wire rope wound on said winding drum is applied.

4. A hoisting winch according to claim 2, wherein said sun gear provided to said other end side of said rotor axle, said first stage planet gears which engage with said sun gear, and said first stage internal gear fitted on said other end side inner peripheral area of said winding drum are formed of a helical gear respectively.

5. A hoisting winch according to claim 1, wherein said planet gears which engage with said sun gear provided at said other end side of said rotor axle are composed of at least three gears, and an angular interval between neighboring planet gears along a circumference direction is set not to exceed 180 degrees.

6. A hoisting winch according to claim 1, wherein said internal gear of said reduction mechanism is formed integrally with said winding drum.

* * * * *